US011730251B2

(12) United States Patent
Carraro et al.

(10) Patent No.: US 11,730,251 B2
(45) Date of Patent: Aug. 22, 2023

(54) JAR, ESPECIALLY FOR COSMETIC PRODUCTS

(71) Applicant: Albea Services, Gennevilliers (FR)

(72) Inventors: Daniel Carraro, Gennevilliers (FR); Franck Seguin, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 257 days.

(21) Appl. No.: 17/189,191

(22) Filed: Mar. 1, 2021

(65) Prior Publication Data

US 2021/0267350 A1 Sep. 2, 2021

(30) Foreign Application Priority Data

Feb. 28, 2020 (FR) ..... 2002022

(51) Int. Cl.
*A45D 40/00* (2006.01)
*A45D 33/00* (2006.01)

(52) U.S. Cl.
CPC ..... *A45D 40/0068* (2013.01); *A45D 33/008* (2013.01)

(58) Field of Classification Search
CPC .... A45D 40/00; A45D 40/0068; A45D 40/22; A45D 40/221; A45D 40/222; A45D 42/02; A45D 34/00; A45D 2034/002; A45D 33/00; A45D 33/003; A45D 33/006; A45D 33/025; A45D 33/14; A45D 33/16; A45D 33/22; A45D 33/24
See application file for complete search history.

(56) References Cited

U.S. PATENT DOCUMENTS 5,975,093 A 11/1999 Joulia
6,378,533 B1 * 4/2002 Roman ..... A45D 33/006 220/4.27
6,932,220 B2 * 8/2005 Byun ..... A45D 33/20 132/294
6,988,630 B2 * 1/2006 Matsumoto ..... B65D 21/0228 206/823
D581,597 S * 11/2008 Martinez ..... D28/82
8,109,280 B2 * 2/2012 Winckels ..... A45D 40/221 132/294
8,292,110 B2 * 10/2012 Rutter ..... B65D 47/0838 220/817

(Continued)

FOREIGN PATENT DOCUMENTS

CN 203913814 U 11/2014

*Primary Examiner* — Cris L. Rodriguez
*Assistant Examiner* — Karim Asqiriba
(74) *Attorney, Agent, or Firm* — Kilpatrick Townsend & Stockton LLP

(57) ABSTRACT

A jar, in particular for a cosmetic product, includes a base configured to contain said product, a lid configured to be screwed reversibly onto the base along a screwing axis, the jar further including an intermediate piece ensuring a pivotal mounting of said lid on the base along an axis transverse to the screwing axis. The lid includes at least a first interface wall the is a first lateral skirt positioned opposite a lateral ring of a second interface wall that is an intermediate piece. One of the interface walls is provided with at least one helical groove in which a counterpart formed on the other of the interface walls engages by sliding between a lower position and an upper position, enabling pivoting.

11 Claims, 6 Drawing Sheets

(56) References Cited

U.S. PATENT DOCUMENTS

| | | | | |
|---|---|---|---|---|
| 8,919,355 | B2 * | 12/2014 | Blanch | A45D 40/221<br>206/823 |
| 2003/0217761 | A1 * | 11/2003 | Maelstaf | A45D 33/006<br>132/294 |
| 2010/0307521 | A1 * | 12/2010 | Pires | A45D 33/006<br>220/736 |

* cited by examiner

JAR, ESPECIALLY FOR COSMETIC PRODUCTS

CROSS REFERENCE TO RELATED APPLICATIONS

This application claims priority under 35 U.S.C. § 119(a) to French patent application 2002022 filed on Feb. 28, 2020, the entire teachings of which are incorporated herein by reference.

BACKGROUND OF THE INVENTION

Field of the Invention

The invention relates to a jar, in particular for cosmetic products. This concerns products that may be in the form of a cream, compact cream, compressed powder, liquid, and so on.

Description of the Related Art

In the field of packaging of cosmetic products, it is known that there are jars of small dimensions enabling their storage and/or transport, for example in a handbag. Such jars generally include a base to hold the cosmetic product, as well as a lid that closes the base, for storage and/or transport.

In order to ensure tight closure of the base by the lid, it is known to provide a thread on said base, configured to interact with a counter-thread of said lid. Further, in order to permanently connect the lid to the base, it is known to provide a hinge connection between said lid and said base. U.S. Patent Application 9,452,873 to Eberlein in particular shows ajar in which these technical principles are implemented.

However, the jar according to Eberlein is not fully satisfactory in that the lid is made of several parts, the manufacture and assembly of which generate costs that are necessarily reflected in the final cost price of the jar. In addition, in the pivoted position with respect to the base, the lid remains unstable; and in the folded position with respect to the base, the lid has a thread that is not necessarily aligned with that of the base. This results in an inconclusive user experience. Finally, the jar according to Eberlein has a relatively large height, whereas a space-saving jar is preferable.

BRIEF SUMMARY OF THE INVENTION

The invention aims to overcome the above-mentioned disadvantages, at least partially, and for this purpose proposes a jar, in particular for a cosmetic product, comprising a base configured to contain the said product, a lid configured to be screwed reversibly onto the said base along a screwing axis, said jar further comprising an intermediate piece ensuring a pivotal mounting of said lid on said base around an axis transversal to the screwing axis, said lid comprising at least a first lateral skirt, called the first interface wall, positioned facing a lateral ring of said intermediate piece, called the second interface wall. According to the invention, one of the interface walls is provided with at least one helical groove in which a counterpart formed on the other of the interface walls engages by sliding between a lower position and an upper position, enabling pivoting.

In this way, the lid can be screwed and unscrewed with respect to the base without being hindered in its movement by the intermediate piece, while enabling angular indexing with respect to said base or said intermediate piece.

The jar according to the invention may also have the following features, taken alone or in all technically possible combinations that form just as many embodiments of the invention:

- the lid comprises a second lateral skirt as well as a base connecting said second lateral skirt to the first lateral skirt to form an annular groove;
- the annular groove receives the lateral ring of the intermediate piece;
- the first lateral skirt extends around the entire periphery of the lid;
- the helical groove is configured to be traversed by the counterpart when screwing or unscrewing the lid relative to the base;
- the first lateral skirt and the second lateral skirt of the lid are made with the lid in one piece;
- at least one between the first lateral skirt and the second lateral skirt of the lid has a free edge configured to be in contact with a horizontal plate of the base when the counterpart is in a low position in the helical groove;
- the counterpart is defined by a lug;
- the helical groove includes at least one upper stop configured to interact with its counterpart in the up position, in order to impede any relative movement between the lid and the intermediate piece when pivoting with respect to the base;
- the helical groove comprises at least one lower stop configured to interact with said counterpart in a lower position, in order to impede any relative movement between said lid and the intermediate piece in a closed position of said lid;
- the jar is configured so that when the counterpart passes over one of the upper or lower stops, a snap is produced, specifically an audible snap, indicating the end of screwing or unscrewing the lid relative to the base;
- the intermediate piece is mounted on the base by means of a hinge positioned in the lower part of said base;
- the intermediate piece comprises a housing configured to receive a locking tab formed on the base, in order to reversibly lock said intermediate piece on said base;
- the jar is configured so that the positioning of the counterpart in the upper position in the helical groove, prior to screwing, enables an alignment between a thread of said lid and a counter-thread of the base;
- one of said interface walls comprises three counterparts distributed angularly and spaced 120° apart, the other of said interface walls comprises three helical grooves;
- the lid remains attached to the base in the open position and is angularly positioned so as to visualize a mirror;
- the bottom of the lid is provided with at least one opening;
- said opening opens into the annular groove;
- said opening is located in line with said counterpart;
- the lid is equipped with a cover.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1A:
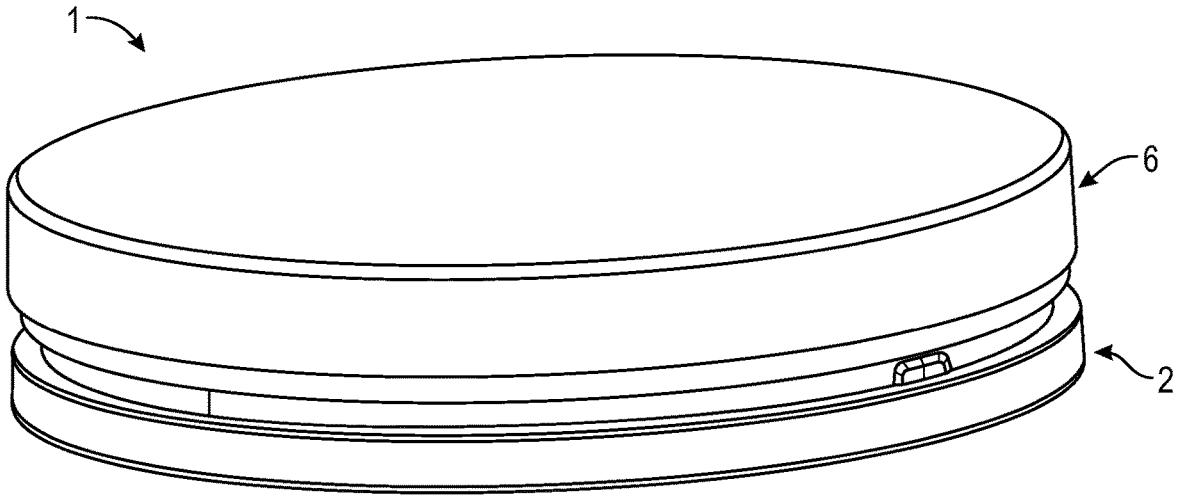
FIG. 1*a* is a front isometric view of a jar.
Figure 1B:
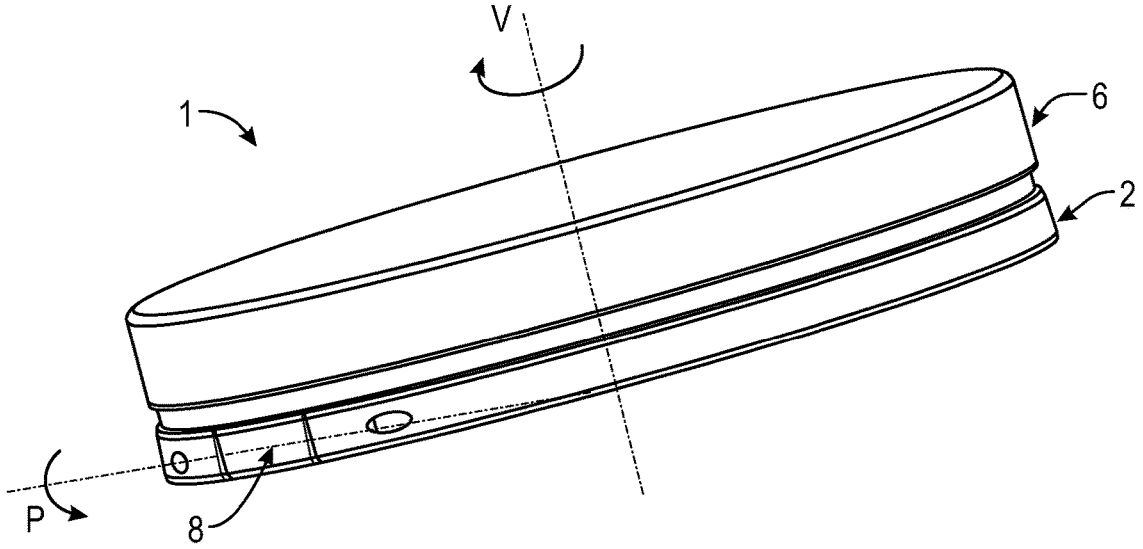
FIG. 1*b* is a rear isometric view of a jar.

As illustrated in FIGS. 1*a* and 1*b*, the invention relates to a jar 1, in particular for cosmetic products. It may be a cosmetic case, for example. The said jar 1 comprises a base 2 and a lid 6, which form a cylindrical body with a diameter greater than the height. The base 2 is configured to hold contents in the form of cream, cream compact, compressed powder, for example, or liquid. The lid 6 is configured to reversibly close said base 2 and establish a coupling with said base. An intermediate piece 8 connects the base 2 and the lid in both the open and closed position of the jar 1.

Figure 2:
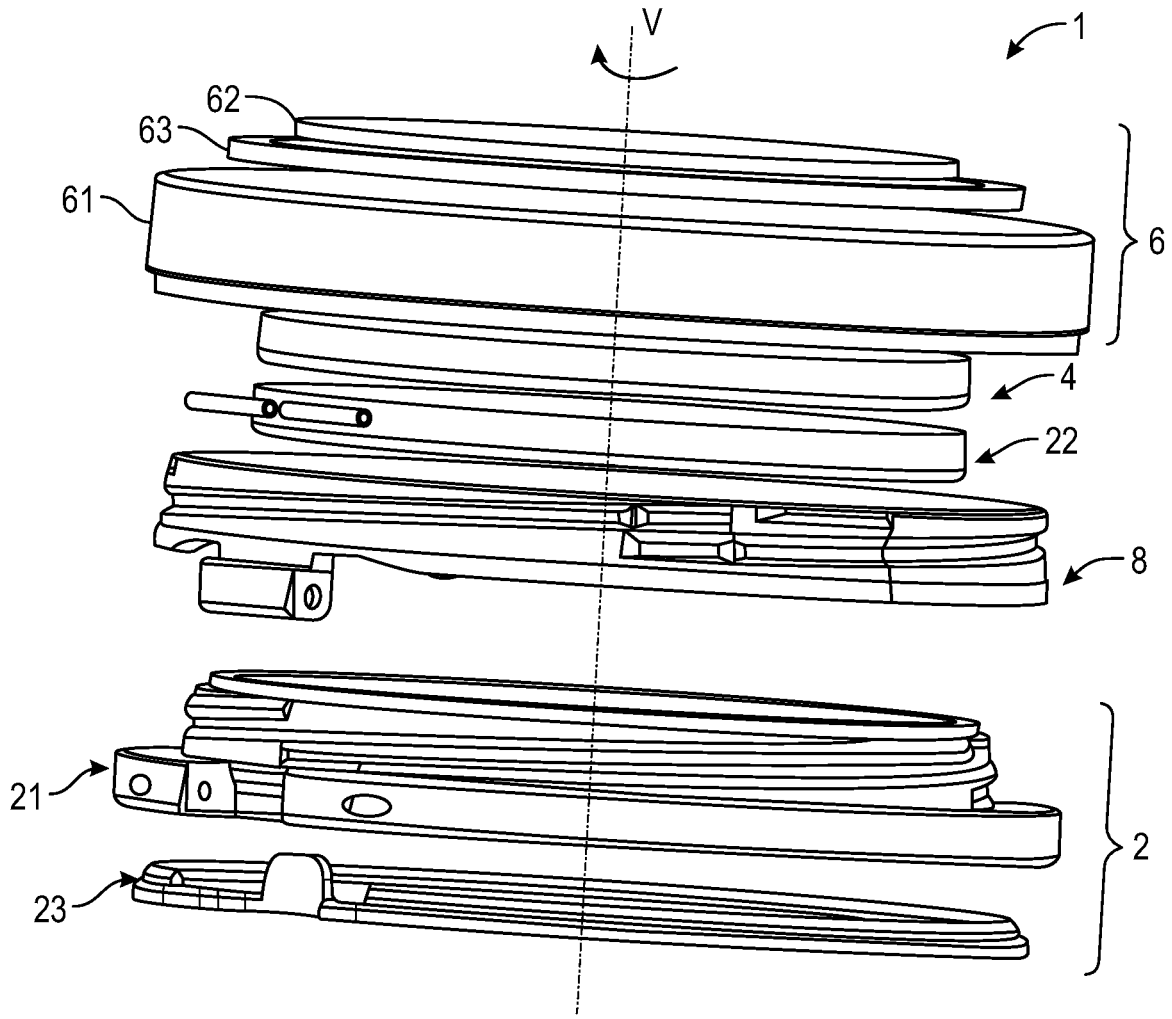
FIG. 2 shows an exploded isometric view of the jar of FIGS. 1*a* and 1*b*.

Referring to FIG. 2, the base 2 includes a first part 21 configured to receive a cup 22, which is in contact with the product 4, and a lower block 23 forming a support surface for the jar 1.

Figure 3A:
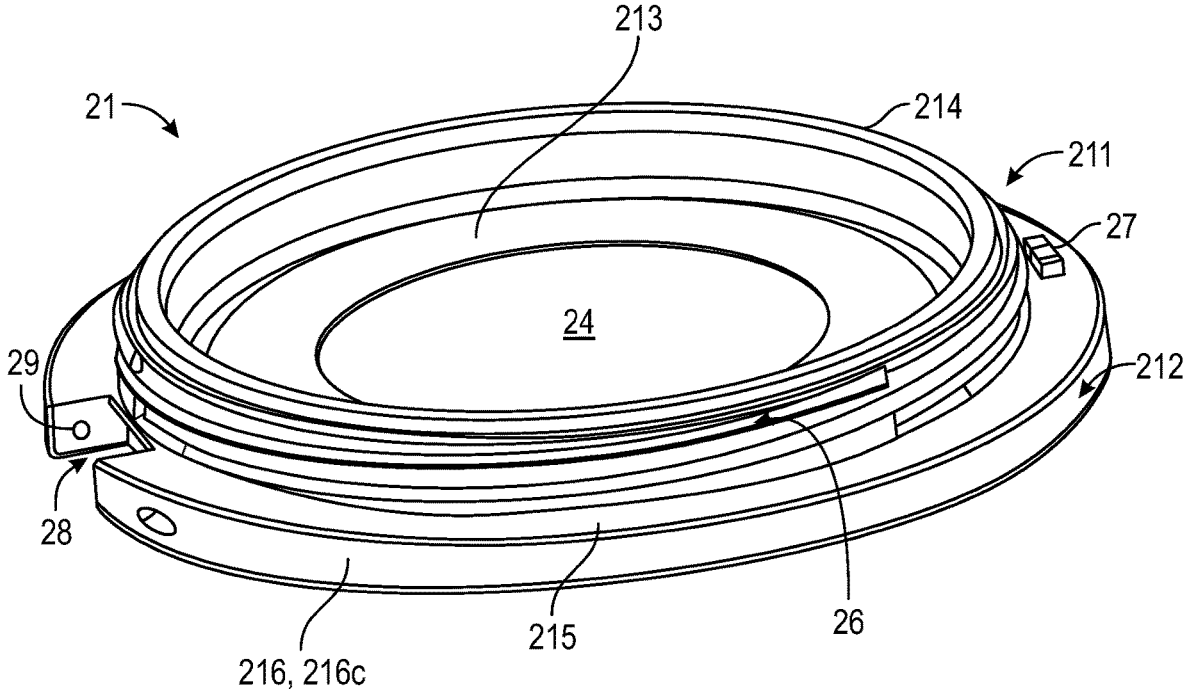
FIG. 3*a* is a top isometric view of a base of the jar of FIGS. 1*a* and 1*b:*
Figure 3B:
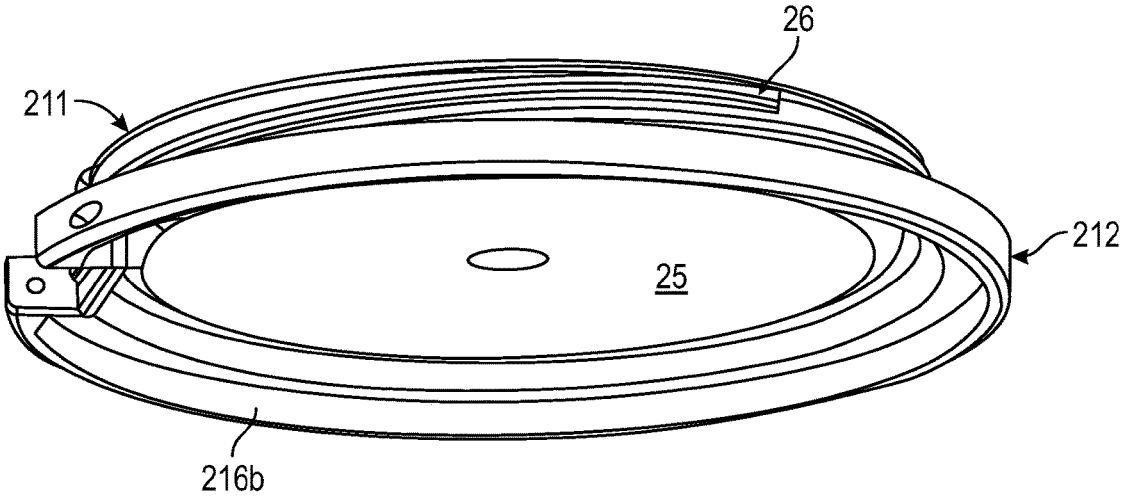
FIG. 3*b* is a bottom isometric view of a base of the jar of FIGS. 1*a* and 1*b;*

In particular, as shown in FIGS. 3*a* and 3*b*, the first part 21 of the base 2 includes a receptacle 211 and a peripheral ring-shaped support 212. The receptacle 211 includes a first bottom 213 as well as a lateral skirt 214 that forms a first housing 24 with the said first bottom for receiving the cup 22. The support 212 includes a horizontal plate 215 as well as a periphery 216 that with the first bottom 213 of receptacle 211 forms a second housing 25 configured for the assembly of the lower block 23. When viewed from the second housing 25, the first bottom 213 and the horizontal plate 215 can be connected by radial reinforcement arms (not shown).

According to the embodiment shown, the said first part 21 is made by molding. Thus, the receptacle 211 and the support 212 are made in one piece. However, the receptacle 211 and the support 212 can form two distinct parts obtained separately and then assembled by any technique known to the person skilled in the art.

According to the embodiment shown, the lower block 23 is held in position in the second housing 25 of the base 21 by gluing. However, in an embodiment not shown, the lower block 23 has a radial projection configured to engage in a groove formed on an inner face 216*b* of the support 212.

Referring again to FIG. 2, the cup 22 is made by molding aluminum, polymer, for example, or any other material compatible with the product 4. In addition, the cup 22 is held in position in the first housing 24 of the base 2 in a reversible or non-reversible manner. In the latter case, the cup 22 can be fixed in the first housing 24 by gluing or any other technique known to the person skilled in the art.

Still with reference to FIG. 2, the lid 6 comprises a main body 61 that is equipped with an accessory, for example a mirror 62, and a gasket 63.

Figure 4A:
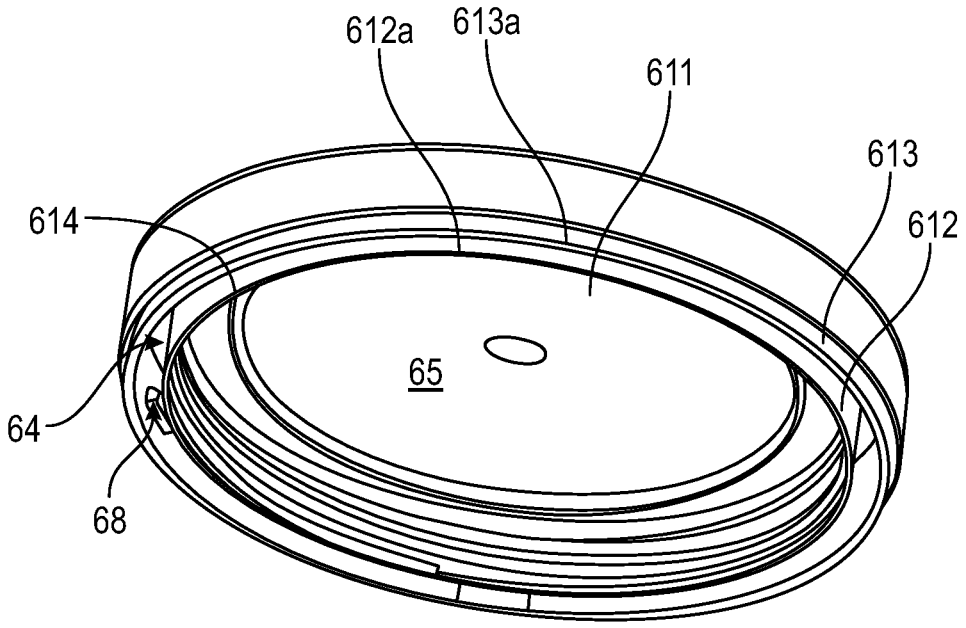
FIG. 4*a* through 4C, taken together, show an isometric view of a lid of the jar.
Figure 4B:
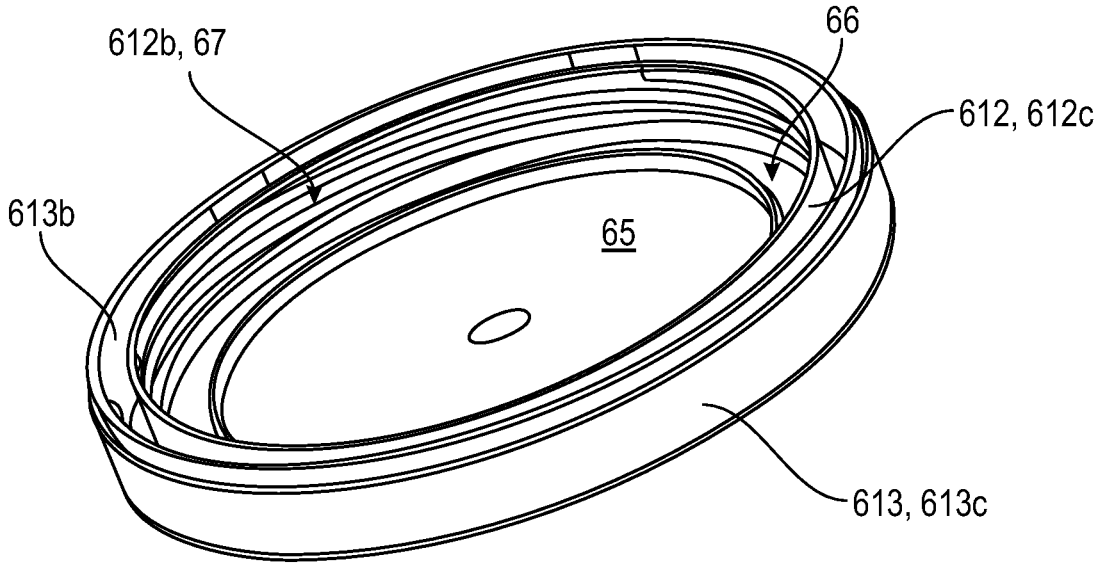
Figure 4C:
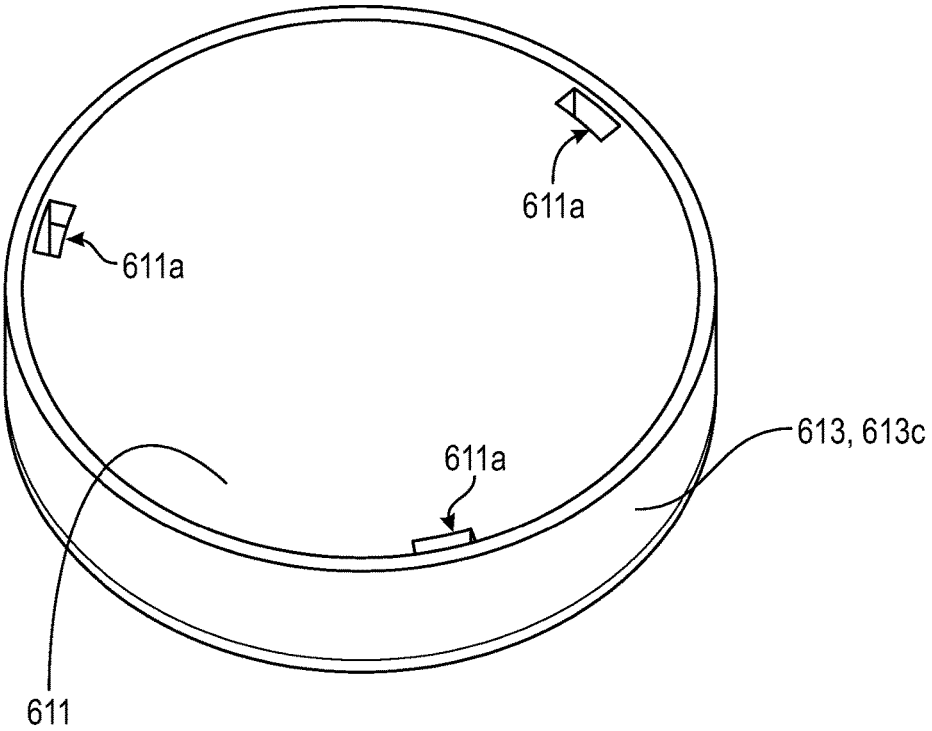

In particular, with reference to FIGS. 4*a-c*, the main body 61 of the lid 6 comprises a bottom, called second bottom 611 as well as a first lateral skirt 612 and a second lateral skirt 613 that extend from said second bottom to forming a groove, called first annular groove 64, with said second bottom. The second bottom 611 is provided with a circular ridge 614 that delimits a central area 65 configured to receive the mirror 62. The said circular ridge 614 forms a groove, called second annular groove 66, with either the first lateral skirt 612 or the second lateral skirt 613, called the inner skirt. The gasket 63 is assembled in the second annular groove 66. Either the first lateral skirt 612 or the second lateral skirt 613, called the outer skirt, extends over the entire periphery of the main body 61.

According to the embodiment shown, the first lateral skirt 612 forms the inner skirt of the lid 6. The said lateral skirt 612 has an inner face 612*b* that is provided with a thread 67 configured to interact with a matching thread 26 formed outerly on the lateral wall 214 of the receptacle 211. Thus, the closing of the base 2 by the lid 6 is done by screwing, which ensures a better sealing of the jar 1 and better conservation of the product 4.

It should be noted that when the lid 6 is completely screwed on the base 2, at least either a free edge 612*a* of the first lateral skirt 612 and a free edge 613*a* of the second lateral skirt 613 is flush with the horizontal plate 215 of the support 212. Moreover, an outer face of the lid 6 as well as an outer face 216*c* of the periphery 216 of the base 2 are aligned. This arrangement gives the jar 1 its cylindrical shape, shown in FIGS. 1*a* and 1*b*.

Figure 5:
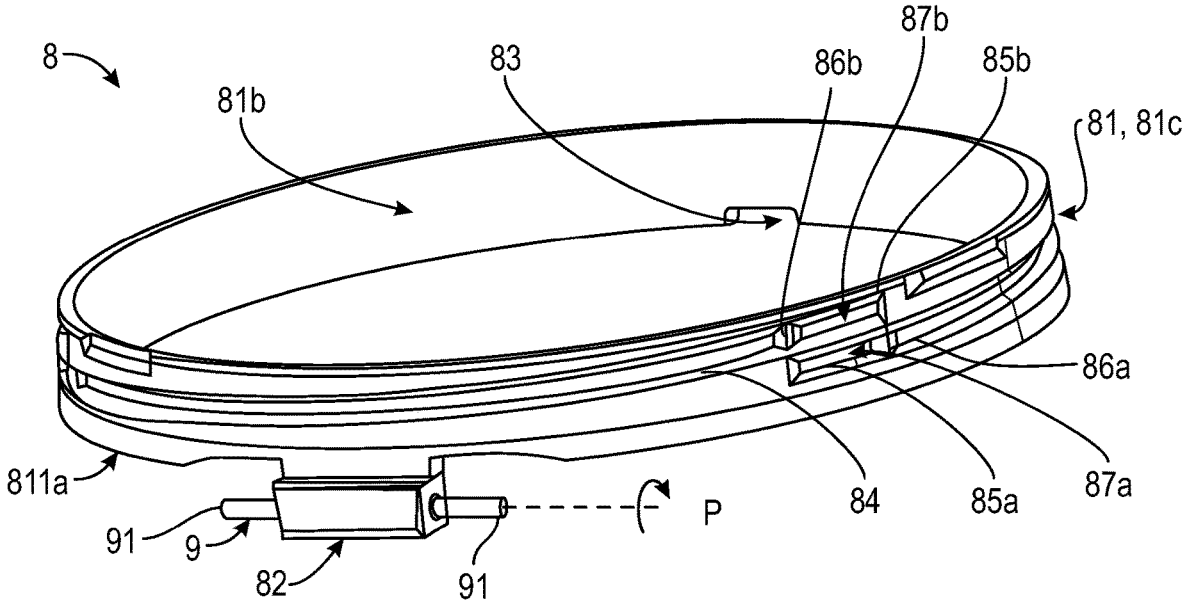
FIG. 5 shows an isometric view of an intermediate piece of the jar in FIGS. 1*a* and 1*b*.

Referring to FIG. 5, the intermediate piece 8 comprises a ring 81 as well as a projection 82 that extends vertically from a lower edge 811*a* of said ring 81. In particular, the ring 81 is configured to receive the main body 61 of the lid 6. The projection 82 is configured to be mounted on the first part 21 of the base 2 by means of a transverse hinge 9. This hinge 9 ensures the pivoting of the said intermediate piece 8 with respect to the base 2 according to a pivot axis P transverse to the screwing axis V.

In order to enable its reversible locking on the first part 21 of the base 2, the intermediate piece 8 also comprises at least one housing 83 configured to receive a locking tab 27 formed at the level of the horizontal plate 215 of said first part 21. The housing 83 is formed at the lower edge 811*a* of the ring 81, preferably opposite the projection 82.

According to a preferred embodiment of the invention, the hinge 9 ensuring the pivoting of the intermediate piece 8 with respect to the first part 21 of the base 2 is positioned on a lower part of said first part 21.

For this purpose, with reference to FIG. 3*b*, the first part 21 of the base 2 has a notch 28 at the level of the support 212 that receives the projection 82 of the intermediate piece 8. The hinge 9 mounted through the projection 82 has ends 91 that are received in lateral openings 29 in communication with the notch 28.

This positioning of the hinge 9 reduces the overall space requirement of the jar 1.

According to the invention, the intermediate piece 8 is configured to accompany the screwing or unscrewing of the lid 6 with respect to the base 2, preferably between two positions impeding any relative movement of said lid 6 with respect to said intermediate piece 8.

To do so, in the embodiment illustrated in FIGS. 4*a-c*, the second skirt 613 of lid 6 has an inner face 613*b*, called the first interface wall, which is provided with at least one radial counterpart 68. In addition, with reference to FIG. 5, the ring 81 of the intermediate piece 8 has an outer face 81*c*, called the second interface wall, which is provided with at least one helical groove 84. This helical groove 84 receives the said counterpart 68 by sliding.

Advantageously, the inner face 613*b* of the lid 6 has three radial counterparts 68, which are angularly distributed and preferably spaced at 120° to each other. The outer face 81*c* of the ring 81 comprises three matching helical grooves 84 that are equally angularly distributed such that each helical groove 84 has an upper portion extending over a lower portion of an adjacent helical groove.

Such configuration of counterparts 68 and grooves 84 enables good support of the lid 6 on the intermediate piece 8, in particular by limiting any risk of tilting of the said lid with respect to the said intermediate piece 8.

In particular, the said helical groove 84 has a screw thread identical to that of the thread 67 of the lid 6. This prevents any interference of the intermediate piece 8 on the screwing and unscrewing movement of the lid 6 in relation to the base 2.

In addition, said helical groove 84 is provided with a first end stop 85*a* and/or a second end stop 85*b*, here formed by end walls of said helical groove 84. This helical groove 84 is also provided with a first intermediate stop 86*a* adjacent to said first end stop 85*a* and/or a second intermediate stop 86*b* adjacent to said second end stop 85*b*.

Each end stop 85*a*, 85*b* along with its adjacent intermediate stop 86*a*, 86*b* forms a locking chamber 87*a*, 87*b* in which the said counterpart 68 engages, at the end of screwing and/or at the end of unscrewing of the lid 6 with respect to the base 2. The said locking chamber 87*a*, 87*b* has a depth greater than that of the said helical groove 84, in through-thickness-direction of the ring 81. Thus, the engagement of said counterpart 68 in said locking chamber 87*a*, 87*b* makes it possible to impede any relative movement of said lid 6 with respect to the intermediate piece 8 at the end of screwing and/or at the end of unscrewing of said lid 6 with respect to said base 2. In particular, at the end of unscrewing, such an engagement of the counterpart 68 in the locking chamber 87*b* makes it possible to immobilize the lid 6 on the intermediate piece 8 during the pivoting of the said lid with respect to the base 2.

In one embodiment not shown and according to the invention, the counterpart(s) 68 is/are positioned on the outer face 81*c* of the ring 81. The helical groove(s) and the related stops are then formed on the inner face 613*b* of the second skirt 613.

In another embodiment not shown and according to the invention, the accompaniment of the screwing or unscrewing of the lid 6 by the ring 81 of the intermediate piece 8 implements an outer face 612*c* of the first skirt 612 as the first interface wall, and an inner face 81*b* of the said ring 81 as the second interface wall. One of these two interface walls then comprises the helical groove(s) and the related stops, and the other of these interface walls comprises the counterpart(s).

According to a preferred embodiment of the invention, the intermediate stops 86*a*, 86*b* of each helical groove 84 are configured to be crossed by the counterparts 68 of lid 61 by snap-fitting, thus possibly producing an audible click, intended to mark the beginning or the end of the screwing or unscrewing of lid 6 with respect to the base 2.

Advantageously, the bottom 611 as well as the first lateral skirt 612 and the second lateral skirt 613 which form the main body 61 of the lid 6 are made in one piece. Such a part is obtained by injection molding, for example, or by any other technique known to the person skilled in the art. The manufacturing material of the main body 61 of the lid 6 is selected from aluminum, aluminum alloy, polymer, and so on.

For manufacturing by injection molding, it is necessary to anticipate the difficulties of demolding, particularly those related to the presence of the counterparts 68 in a narrow space formed by the first annular groove 64.

According to one embodiment of the invention, the injection molding is carried out using a mold that comprises at least one outer and at least one inner shell. The outer shell has a wall, called the outer horizontal wall, which is configured to form an outer face of the bottom 611. In addition, the outer shell has a wall, called the outer vertical wall, which is configured to form an outer face of the outer skirt 613. The inner shell has a wall, called the inner horizontal wall, which is configured to form an inner face of the bottom 611. In addition, the inner shell has an upper wall, called the first inner vertical wall, which is configured to form an upper portion of the inner face 613*b* of the outer skirt 613, and a lower wall, called the second inner vertical wall, which is configured to form a lower portion of the inner face 613*b* of the outer skirt 613. The inner vertical walls of the inner shell are two distinct elements that configured to be positioned on either side of the region(s) of the mold intended for the formation of the counterpart(s) 68.

To make the counterpart(s) 68 on the inner face 613*b* of the outer skirt 613, the outer shell presents at least one core, called upper core, which extends from the outer horizontal wall. This or these upper cores are positioned against the first inner vertical wall. The inner shell presents at least one core, called the lower core, which is positioned against the second inner vertical wall. The upper core or cores are configured to be aligned with the lower core or cores in the region or regions of the mold intended for the formation of the counterpart(s) 68. Thus, an upper portion of the counterpart (s) 68 is obtained using the upper core(s). A lower portion of the counterpart(s) 68 is obtained using the lower core(s).

The lower core(s), as well as the upper core(s), is (are) tapered in shape. Thanks to this shape, the extraction of the main body 61 from the mold is carried out without difficulty according to a so-called natural demolding.

After demolding, the main body 61 has one or more openings 611*a* at the bottom 611. This opening or these openings 611*a* indicate the prior presence of the upper core or cores in the mold. This opening or openings 611*a* open into the annular groove 64 in line with the counterpart(s) 68 (see FIG. 4*c*).

According to another embodiment, one or more rising wedges are associated with the injection mold, which are intended to enable a smooth opening of the mold, after solidification of the molding material, and to free the counter-part(s) 68 without affecting the structural integrity of the latter. The rising wedge(s) is (are) introduced into the mold so as to be positioned in the vicinity of the region(s) in which the counterpart(s) 68 is (are) intended to be formed. A portion of the rising wedge(s) remains outside the mold.

More specifically, the rising wedge(s) is (are) introduced into the mold through a wall of the mold that is intended to form the bottom 611 of the main body 61. After solidification of the casting material, the rising wedge(s) is (are)

removed from the mold by sliding through the main body 61 thus formed. The latter then presents one or more openings 611*a* at the level of the bottom 611, indicating the previous presence of the rising wedge(s) in the mold. This opening or these openings 611*a* open into the annular groove 64 in line with the counterparts 68 (see FIG. 4*c*).

In order to mask the opening(s) 611*a* formed through the bottom 611 of the body 61, a cover (not shown) is provided on the outside of said bottom 611. This cover thus has a hubcap function. In addition, it can be used as a support for any type of marking on the upper body 61 of the lid 6. In addition, this cover is attached to the outside of the bottom 611 by means of a snapping mechanism. For this purpose, the outer side of the bottom 611 has a circular rim forming a recess in which the cover fits. As an alternative and/or in addition, the cover has an inner face with one or more tabs configured to fit into opening(s) 611*a* of the bottom 611.

In one embodiment not shown, the main body 61 of the lid 6 is obtained without the formation of openings in the bottom 611. For this embodiment, it is not necessary to provide an additional cap on the outside of the bottom 611.

The jar 1 ready for use can be presented in closed position, in which the lid 6 is completely screwed on the base 2, and the second skirt 613 of the said lid advantageously conceals the ring 81 of the intermediate piece 8, at least partly; and in which the counterparts 68 are positioned in the first locking chamber(s) 87*a*, the locking tab 27 being engaged in the housing 83 formed on the ring 81.

To open the jar 1, the user first unscrews the lid 6 from the base 2. This movement is accompanied by a free sliding of the counterpart(s) 68 into the helical groove(s) 84 from the first locking chamber(s) 87*a* to the second locking chamber (s) 87*b*. The exit and/or entry of the counterpart(s) 68 into the locking chamber(s) 87*a*, 87*b* is marked by a click. At the end of unscrewing, the lid 6 is locked to the intermediate piece 8 by positioning the counterpart(s) 68 in the second locking chamber(s) 87*b*. The user can then release the assembly formed by the lid 6 and intermediate piece 8 from the locking tab 27 and open the jar 1 by pivoting this assembly around the pivot axis P.

Figure 6:
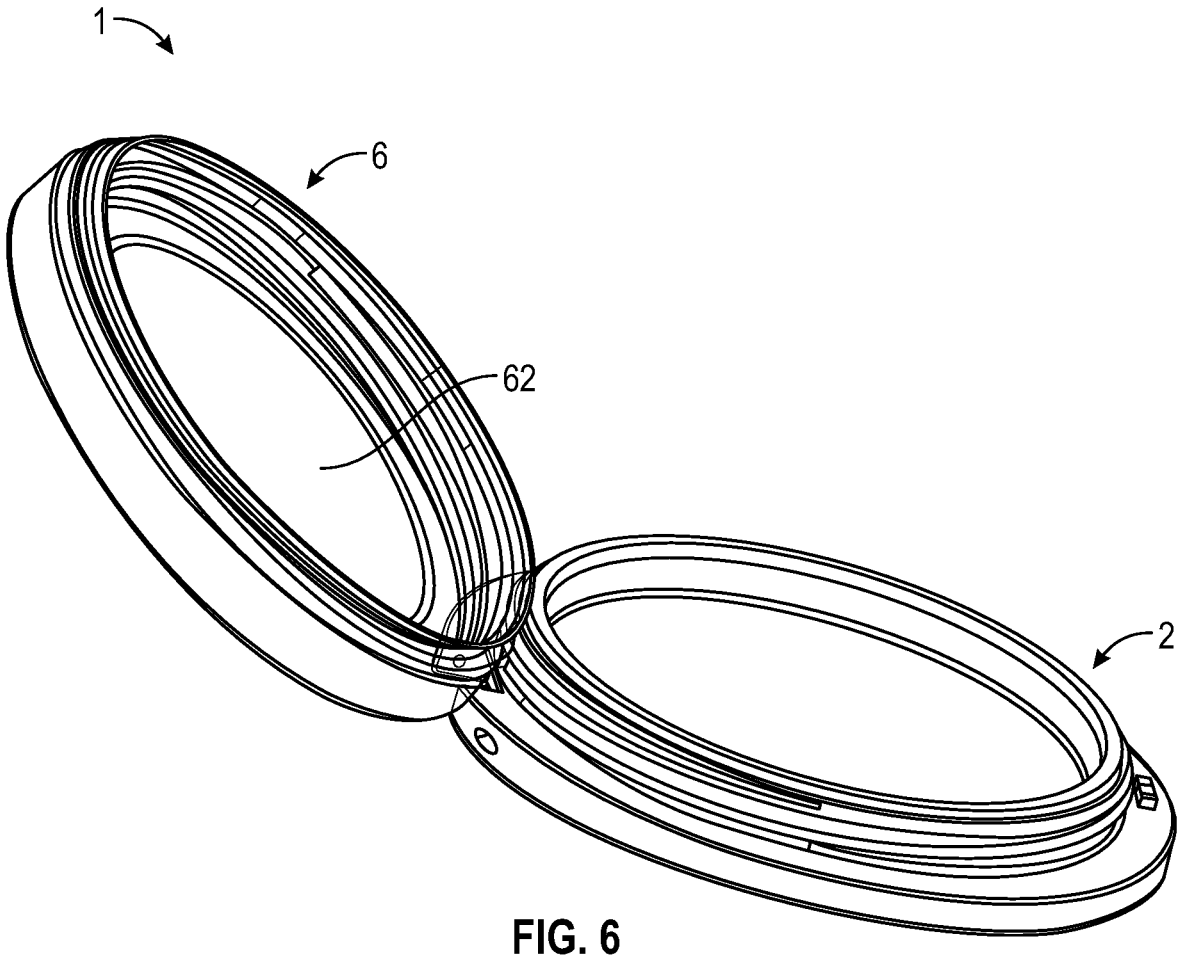
FIG. 6 shows an isometric view of the jar of FIGS. 1*a* and 1*b* in the open position.

The pivoting of the lid 6 and intermediate piece 8 in relation to the base 21 is smooth, that is, without relative movement of the lid 6 in relation to intermediate piece 8, by securing the lid to the ring 81 via the locking chamber(s) 87*b*. This pivoting allows in particular to position the lid 6 angularly with respect to the base 1 so as to visualize the mirror 62 (see FIG. 6).

The positioning of the counterpart 68 in the locking chamber(s) 87*b* at the end of unscrewing is such that, after folding down the lid 6 onto the base 2, the thread of said lid 6 is aligned with the thread of said base. Thus, the closing of the jar 1 by screwing the lid 61 back onto the base 21 is facilitated. Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A cosmetic jar comprising a base configured to contain product, a lid screwed reversibly onto said base along a screwing axis, said jar further comprising an intermediate piece ensuring a pivotal mounting of said lid on said base along an axis transverse to the screwing axis, said lid comprising at least a first lateral skirt, called a first interface wall, positioned opposite a lateral ring of said intermediate piece, called a second interface wall, wherein one of the interface walls is provided with at least one helical groove wherein a counterpart lug formed on the other of the interface walls engages by sliding between a lower position and an upper position, enabling pivoting, and said lid further comprises a second lateral skirt as well as a bottom connecting said second lateral skirt to the first lateral skirt to form an annular groove for receiving the lateral ring, the first lateral skirt extending over an entire periphery of the lid, the helical groove being configured to be traversed by the counterpart lug when screwing or unscrewing said lid with respect to the base.

2. The jar according to claim 1, wherein the first lateral skirt and the second lateral skirt of the lid are made in one piece with said lid.

3. The jar according to claim 1, wherein the first lateral skirt and the second lateral skirt of the lid have a free edge configured to contact a horizontal plate of the base when said counterpart is in a low position in said helical groove.

4. The jar according to claim 1, wherein said at least one helical groove includes at least one upper stop configured to interact with said counterpart lug in the upper position, in order to impede relative movement between said lid and the intermediate piece during pivoting.

5. The jar according to claim 4, configured so that a crossing over of one of the upper stop or lower stop by said counterpart lug produces a snap indicating the end of screwing or the end of unscrewing of the lid with respect to the base.

6. The jar according to claim 1, wherein said at least one helical groove includes at least one lower stop configured to interact with said counterpart lug in a low position, in order to impede relative movement between said lid and the intermediate piece in a closed position of said lid.

7. The jar according to claim 1, wherein the intermediate piece is mounted on the base by means of a hinge positioned at the bottom of said base.

8. The jar according to claim 1, wherein the intermediate piece comprises a housing configured to receive a locking tab formed on the base, in order to reversibly lock said intermediate piece to said base.

9. The jar according to claim 1, configured so that positioning of said counterpart lug in an upper position in said helical groove enables alignment between a thread of said lid and a counter-thread of said base, prior to screwing.

10. The jar according to claim 1, wherein one of said interface walls comprises three counterpart lugs angularly distributed and spaced 120° apart, the other of said interface walls comprising three helical grooves.

11. The jar according to claim 1, wherein the lid remains attached to the base in an open position and is angularly positioned so as to visualize a mirror.

* * * * *